US006102772A

United States Patent [19]

Fernandez

[11] Patent Number: 6,102,772

[45] Date of Patent: Aug. 15, 2000

[54] ANTI-WRINKLE BRASSIERE

[76] Inventor: Maria Elisa Fernandez Fernandez, Avenida Profesor Peraza de Ayala, 6-4°B, 38001 Santa Cruz de Tenerife, Spain

[21] Appl. No.: 09/101,843

[22] PCT Filed: Nov. 4, 1997

[86] PCT No.: PCT/ES97/00263

§ 371 Date: Oct. 22, 1998

§ 102(e) Date: Oct. 22, 1998

[87] PCT Pub. No.: WO98/19567

PCT Pub. Date: May 14, 1998

[30] Foreign Application Priority Data

Nov. 4, 1996 [ES] Spain ..... 9602800 U

[51] Int. Cl.[7] ..... A41C 3/00

[52] U.S. Cl. ..... 450/1; 128/488; 450/57

[58] Field of Search ..... 450/1, 2, 8, 13, 450/19, 27, 74, 76, 7, 86, 90; D2/706

[56] References Cited

U.S. PATENT DOCUMENTS

| | | | |
|---|---|---|---|
| 3,710,800 | 1/1973 | Carey | 450/64 |
| 3,746,007 | 7/1973 | Hand et al. . | |
| 4,341,219 | 7/1982 | Kuznetz . | |
| 5,662,512 | 9/1997 | Cohen | 450/1 |
| 5,800,245 | 9/1998 | Barbe-Vicuna et al. | 450/57 |
| 5,807,160 | 9/1998 | Wehmeyer | 450/57 |

FOREIGN PATENT DOCUMENTS

| | | | |
|---|---|---|---|
| 128687 | 7/1946 | Australia | 450/7 |
| 254934 | 5/1981 | Spain . | |
| 254936 | 5/1981 | Spain . | |
| 293610 | 8/1986 | Spain . | |
| 1034899 | 2/1997 | Spain . | |

*Primary Examiner*—John J. Calvert
*Assistant Examiner*—Alissa L. Hoey
*Attorney, Agent, or Firm*—Klauber & Jackson

[57] ABSTRACT

It is specially designed for its night use and as an element for preventing inter-mammary wrinkles. It is also a protection element for the back, the dorsal vertebra and it avoids back pains. It has a front portion (1) which covers its inter-mammary zone and it prolongs on two oblique straps (4) which are joined to the extense back portion (2), preventing the breasts to be joined. The straps which only cover the shoulder part form laterally arches which deviate from the line marked by the day brassiere, for a good lymphatic drainage. It remains fastened to the skin and its inferior border is located at few centimeters under the conventional brassieres.

6 Claims, 4 Drawing Sheets

ANTI-WRINKLE BRASSIERE

OBJECT OF THE INVENTION

The present invention, as it is noted on the heading of this descriptive memory, refers to an anti-wrinkle brassiere, which has been specially designed so as to be used during the night and as an element to prevent inter-mammary wrinkles usually produced on the ages which follow the forty years and mainly on women which a generous chest.

A further object of the invention consists on the protection of the back, as well as of the dorsal vertebra for persons of the mentioned age, preventing arthrosis pains on the dorsal vertebra, as well as protecting from the cold weather.

DESCRIPTION OF THE INVENTION

In broad outlines, the anti-wrinkle brassiere, which is the object of the present invention, characterised in that it is the result of the union of a front part and a back part, preferably of just one piece, although it may also include a back lock or fastener so that the user does not have to put it on over the head.

The front portion covers the total inter-mammary zone (of the order of 6 cm of extension) and it extends into two oblique straps which follow a direction tangent to the parabolas defining the base of the breasts of the women, preventing the breasts, in such a way, to be joined when the woman adopts a reclining position, laying down on one of her sides.

The said straps are joined on the back part or back portion, forming laterally extense sharp arches, which deviate from the line marked by the day brassiere, which provides for a good lymphatic drainage for the user.

Due to its special design, a permanent tension is maintained between the inter-mammary line and the shoulders, avoiding inter-mammary wrinkles due to its special use at night; advantageously it is not provided with the caps which generally exist on the known brassieres, exposing the breasts to the view, since its main function is to maintain that tension so as to avoid and prevent inter-mammary wrinkles.

On the top zone of the straps, or on the confluence of the front and back portions, an elastic and/or adjustable element may exist so as to be fitted on the anatomy of the user.

On the totality of the outline of the brassiere, there is an edged border with a band which maintains the tension and prevents further deformations on the underclothing.

To make it easy to understand of the characteristics of the invention and constituting an integral part of the descriptive memory, some sheets of drawings are enclosed in which figures, with illustrative and non limitative character the following is represented:

DESCRIPTION OF THE PREFERRED EMBODIMENT

In reference to the adopted numeration on the figures, it can be seen how the anti-wrinkle brassiere, proposed by the invention, disposes a front portion 1 and a back portion 2, joined by the side ends 3 and by the straps 4, and a lock or fastener element that may exist on the back vertical line, or on the seams of the front unions; alternatively, it can be manufactured on a closed piece, so that it must be put on over the head.

On this example of realisation shown in the figures, the brassiere does not have any caps and, therefore, the breasts are exposed, since it presents the specific function of preventing the formation of inter-mammary wrinkles, when the user is sleeping, fulfilling therefore its function at night.

Figure 4:
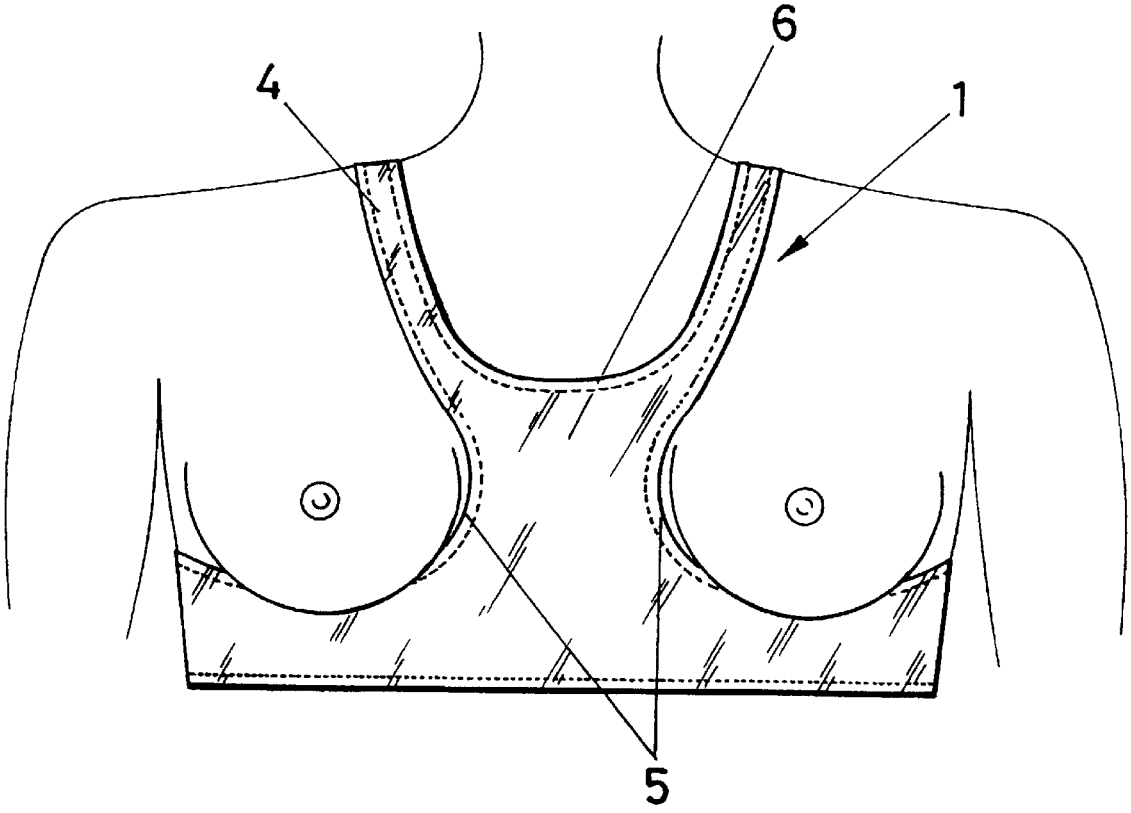
FIG. 4 is an elevation view of the same brassiere, located on the body of the user.

As it can be seen on FIG. 4, the front portion 1 covers widely the inter-mammary zone, splitting the straps 4 on a direction oblique and tangent to the parabolas 5. Reference 6 designates the inter-mammary zone where inter-mammary wrinkles are usually formed, having an extension of the order of 6 cm. so as to accomplish efficiently its function at night, collaborating, naturally, the adequate tension provided by the specific material and the direction of the straps 4. The straps 4 may include an elastic zone 7 as it may be observed on the figures.

The totality of the outline of the brassiere, namely, the front portion 1 as well as the back one 2, includes an edged border 8 with a band which maintains the desired tension.

Figure 1:
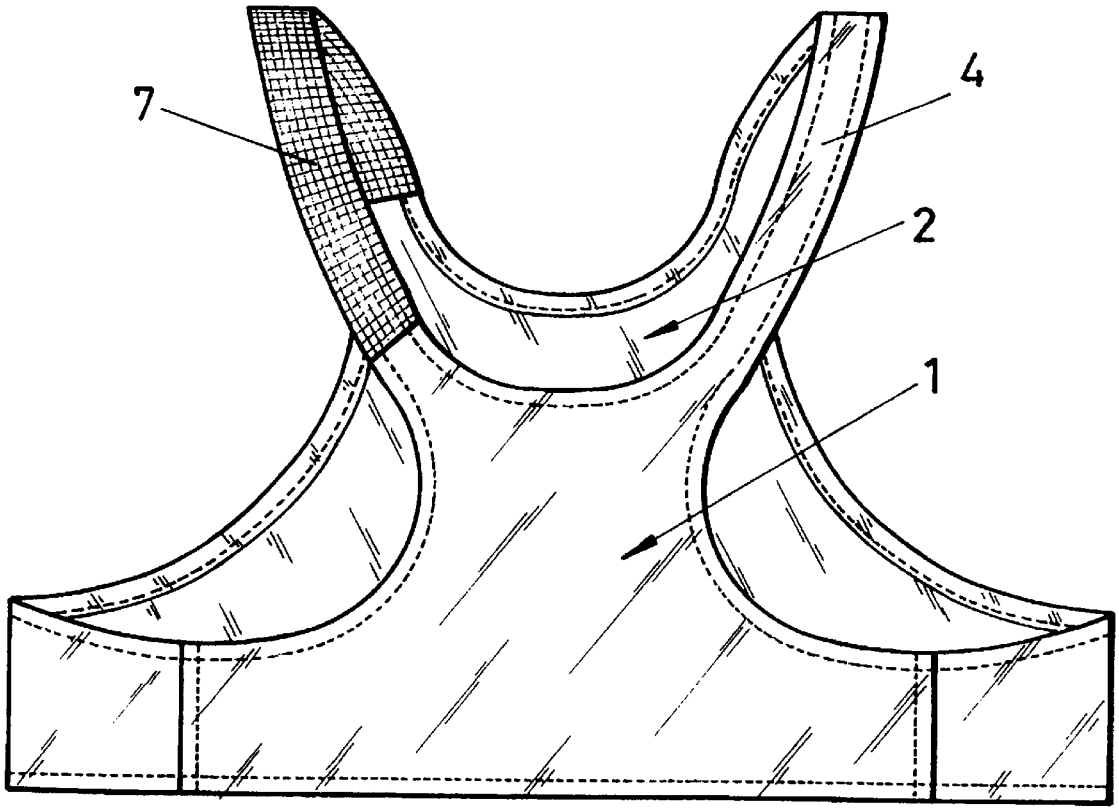
FIG. 1 is an elevation view of the anti-wrinkle brassiere, which is the object of the invention.
Figure 2:
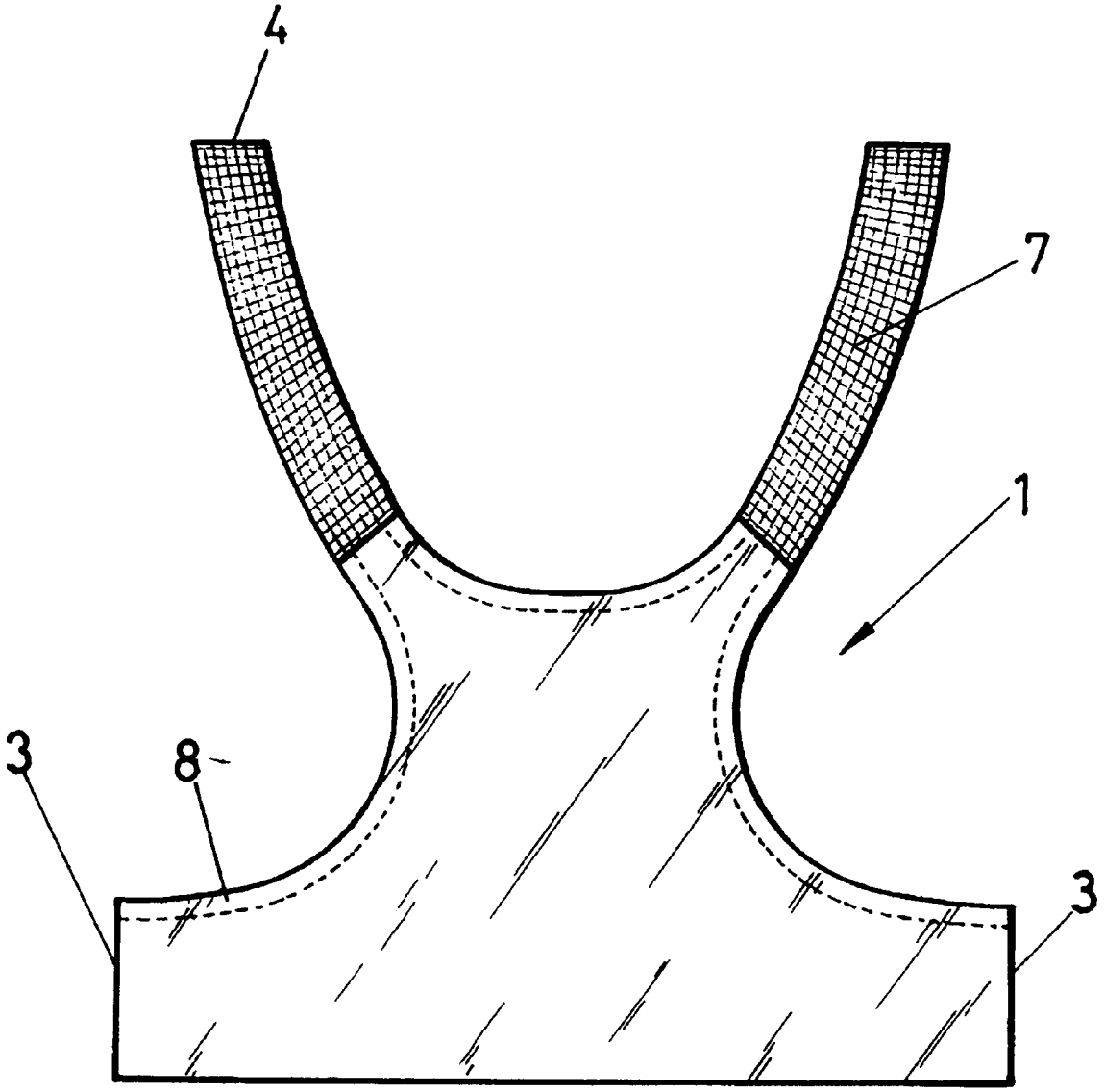
FIG. 2 is a view of the front portion of the same brassiere.
Figure 3:
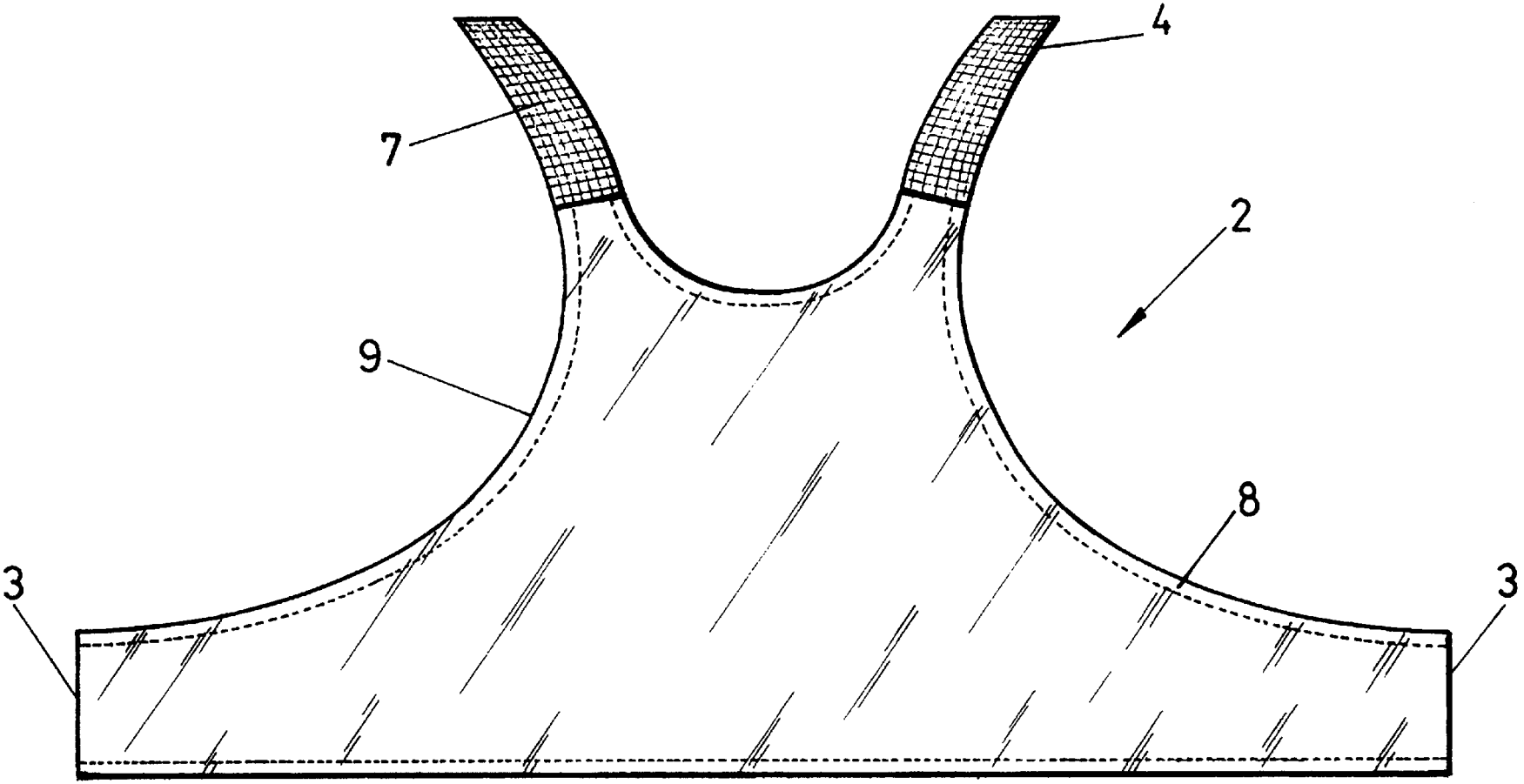
FIG. 3 is a view of the back portion of the same brassiere.

On FIG. 3 it can be seen how the portion of the back 2 covers and extense zone of the user, having sharp arches 9 which prolong on the straps 4, and their direction does not coincide with the one from the day brassiere, so as to provide it with a good lymphatic drainage as it has been already said.

Preferably, the height of the central zone of the back portion 2, will be of approximately 15 cm. so as to protect the dorsal vertebra, which is generally the most affected zone on women with moderately generous or generous breasts.

What is claimed is:

1. ANTI-WRINKLE BRASSIERE, specially designed to be used at night and as an element for preventing inter-mammary wrinkles, and to protect the back, dorsal vertebrae, avoiding back pains, said brassiere comprising:

(a) a front portion, a back portion joined under the breasts to said front portion, and two oblique straps that extend from said front portion to said back portion;

(b) wherein said front portion includes a central part that covers an area between the breasts and extends until a position above the breasts, to prevent the breasts from joining;

(c) said front portion has two concave lateral edges;

(d) said central part of the front portion has a concave upper edge;

(e) said straps continue said concave upper edge of the central part of the front portion and the concave lateral edges of the front portion;

(f) said back portion has a vertical extension that is larger than the vertical extension of said front portion;

(g) said back portion has two concave lateral edges and a concave upper edge of a central part of said back portion;

(h) said straps continue said concave lateral edges of said back portion and said concave upper edge of said central part of said back portion;

(i) along the edges of said brassiere there is a bordered edge with a band to maintain tension in said brassiere and avoid deformation of said brassiere;

(j) said straps are joined in a fixed manner to said back portion as well as to said front portion;

(k) a bottom edge of said front portion is continuous, without apertures.

2. ANTI-WRINKLE BRASSIERE, according to claim 1, characterized in that it exposes the user's breast, since it does not have caps, the straps exerting a tension directed from the inter-mammary line towards the shoulders.

3. ANTI-WRINKLE BRASSIERE according to claim 1, wherein said central part of said front portion has a width of approximately 6 cm., variable depending on the volume of said breasts.

4. ANTI-WRINKLE BRASSIERE according to claim 1, wherein said central part of said back portion has a height of approximately 15 cm., variable depending on the height of the user.

5. ANTI-WRINKLE BRASSIERE according to claim 1, wherein said back portion is closed.

6. ANTI-WRINKLE BRASSIERE according to claim 1, wherein said back portion is provided with a lock.

* * * * *